US010979828B2

(12) United States Patent
Elghannai et al.

(10) Patent No.: US 10,979,828 B2
(45) Date of Patent: Apr. 13, 2021

(54) EAR-WORN ELECTRONIC DEVICE INCORPORATING CHIP ANTENNA LOADING OF ANTENNA STRUCTURE

(71) Applicant: Starkey Laboratories, Inc., Eden Prairie, MN (US)

(72) Inventors: Ezdeen Elghannai, Eden Prairie, MN (US); Karl Joseph Hilde, Minneapolis, MN (US)

(73) Assignee: STARKEY LABORATORIES, INC., Eden Prairie, MN (US)

( * ) Notice: Subject to any disclaimer, the term of this patent is extended or adjusted under 35 U.S.C. 154(b) by 0 days.

(21) Appl. No.: 16/000,552

(22) Filed: Jun. 5, 2018

(65) Prior Publication Data

US 2019/0373381 A1 Dec. 5, 2019

(51) Int. Cl.

| | |
|---|---|
| ***H04R 25/00*** | (2006.01) |
| ***H01Q 1/24*** | (2006.01) |
| ***H01Q 1/27*** | (2006.01) |

(52) U.S. Cl.

CPC ..... *H04R 25/554* (2013.01); *H01Q 1/241* (2013.01); *H01Q 1/273* (2013.01); *H04R 25/558* (2013.01); *H04R 2225/025* (2013.01); *H04R 2225/51* (2013.01)

(58) Field of Classification Search

CPC ..... H04R 25/554; H04R 25/558; H04R 2225/025; H04R 2225/51; H01Q 1/241; H01Q 1/273

See application file for complete search history.

(56) References Cited

U.S. PATENT DOCUMENTS

| | | | | |
|---|---|---|---|---|
| 5,394,159 | A * | 2/1995 | Schneider | H01Q 1/247 343/700 MS |
| 6,429,819 | B1 | 8/2002 | Bishop et al. | |
| 6,762,729 | B2 | 7/2004 | Egashira | |
| 6,762,730 | B2 | 7/2004 | Schadler | |
| 6,768,468 | B2 | 7/2004 | Crouch et al. | |
| 7,016,738 | B1 | 3/2006 | Karunasiri | |
| 7,079,079 | B2 | 7/2006 | Jo et al. | |
| 7,095,372 | B2 | 8/2006 | Soler Castany et al. | |
| 7,148,850 | B2 | 12/2006 | Puente Baliarda et al. | |
| 7,202,822 | B2 | 4/2007 | Baliarda et al. | |

(Continued)

FOREIGN PATENT DOCUMENTS

| | | |
|---|---|---|
| EP | 3316598 A1 | 5/2008 |
| EP | 260613 | 1/2014 |

(Continued)

OTHER PUBLICATIONS

U.S. Appl. No. 15/718,760, filed Sep. 28, 2017, Elghannai et al.

(Continued)

*Primary Examiner* — Sunita Joshi

(74) *Attorney, Agent, or Firm* — Shumaker & Sieffert, P.A.

(57) ABSTRACT

Various embodiments are directed to an ear-worn electronic device configured to be worn by a wearer. The device includes an enclosure configured to be supported by or in an ear of the wearer. Electronic circuitry is disposed in the enclosure and includes a wireless transceiver. An antenna is situated in or on the enclosure and coupled to the wireless transceiver. The antenna includes a first antenna element, a second antenna element, and a chip antenna operably coupled to the first and second antenna elements.

26 Claims, 10 Drawing Sheets

(56) References Cited

U.S. PATENT DOCUMENTS

| | | | | |
|---|---|---|---|---|
| 7,342,545 | B2 | 3/2008 | Huynh et al. | |
| 7,751,902 | B1 | 7/2010 | Karunasiri | |
| 8,259,026 | B2 | 9/2012 | Pulimi et al. | |
| 8,405,561 | B2 | 3/2013 | Handy et al. | |
| 8,406,831 | B2 | 3/2013 | Yang et al. | |
| 8,565,457 | B2 | 10/2013 | Polinske et al. | |
| 8,724,835 | B2 | 5/2014 | Kerselaers et al. | |
| 9,300,367 | B2 | 3/2016 | Christensen et al. | |
| 9,374,650 | B2 | 6/2016 | Bauman | |
| 9,432,779 | B2 | 8/2016 | Kerselaers | |
| 9,484,631 | B1 | 11/2016 | Napoles et al. | |
| 9,635,475 | B2 | 4/2017 | Polinske et al. | |
| 9,641,944 | B2 | 5/2017 | Johnson et al. | |
| 9,706,318 | B2 | 7/2017 | So et al. | |
| 9,906,879 | B2 | 2/2018 | Prchal et al. | |
| 9,980,065 | B2 | 5/2018 | Higgins et al. | |
| 10,070,232 | B2 | 9/2018 | So et al. | |
| 2005/0099341 | A1 | 5/2005 | Zhang et al. | |
| 2005/0117765 | A1 | 6/2005 | Meyer et al. | |
| 2005/0195112 | A1* | 9/2005 | Baliarda | H01Q 13/10 343/700 MS |
| 2006/0093172 | A1 | 5/2006 | Ludvigsen et al. | |
| 2006/0220966 | A1 | 10/2006 | Sarychev et al. | |
| 2006/0239483 | A1 | 10/2006 | Orts et al. | |
| 2008/0267436 | A1 | 10/2008 | Kerselaers et al. | |
| 2008/0278405 | A1* | 11/2008 | Montgomery | H01Q 1/523 343/893 |
| 2008/0287084 | A1 | 11/2008 | Krebs et al. | |
| 2009/0219214 | A1 | 9/2009 | Oh et al. | |
| 2009/0231211 | A1 | 9/2009 | Zweers | |
| 2010/0026775 | A1 | 2/2010 | Parsi et al. | |
| 2011/0022121 | A1 | 1/2011 | Meskins | |
| 2011/0030751 | A1 | 2/2011 | Wu | |
| 2011/0050522 | A1 | 3/2011 | Kuo | |
| 2013/0257676 | A1 | 10/2013 | Kerselaers et al. | |
| 2013/0343586 | A1 | 12/2013 | Kvist et al. | |
| 2014/0091974 | A1 | 4/2014 | Desclos et al. | |
| 2014/0239427 | A1 | 8/2014 | Huang et al. | |
| 2014/0376735 | A1 | 12/2014 | Arsani et al. | |
| 2015/0042524 | A1* | 2/2015 | Kerselaers | H01Q 1/245 343/718 |
| 2015/0049891 | A1* | 2/2015 | Johnson | H04R 25/60 381/315 |
| 2015/0116153 | A1 | 4/2015 | Chen et al. | |
| 2015/0118973 | A1 | 4/2015 | Montgomery et al. | |
| 2016/0050502 | A1 | 2/2016 | Kvist et al. | |
| 2016/0141757 | A1* | 5/2016 | Lai | H01Q 19/005 343/770 |
| 2016/0295335 | A1 | 10/2016 | Vahja et al. | |
| 2016/0330552 | A1* | 11/2016 | Flood | H01Q 9/28 |
| 2016/0366525 | A1 | 12/2016 | Bodvarsson | |
| 2016/0381471 | A1 | 12/2016 | Henriksen et al. | |
| 2017/0150278 | A1 | 5/2017 | Ruaro | |
| 2017/0156011 | A1 | 12/2017 | Rasmussen | |
| 2017/0358867 | A1 | 12/2017 | Akahori | |
| 2018/0027343 | A1 | 1/2018 | Dobson et al. | |
| 2018/0069322 | A1 | 3/2018 | Vouvakis et al. | |
| 2018/0084351 | A1 | 3/2018 | Polinske et al. | |
| 2018/0115055 | A1 | 4/2018 | Hosadurga et al. | |
| 2018/0124528 | A1 | 5/2018 | Polinske et al. | |
| 2019/0098420 | A1 | 3/2019 | Elgahannai et al. | |
| 2019/0116431 | A1 | 4/2019 | Hesselballe et al. | |
| 2019/0116433 | A1 | 4/2019 | Hesselballe et al. | |
| 2019/0116435 | A1 | 4/2019 | Hesselballe et al. | |
| 2019/0261100 | A1 | 8/2019 | Troelsen et al. | |
| 2020/0186947 | A1 | 6/2020 | Prabhu et al. | |

FOREIGN PATENT DOCUMENTS

| | | | |
|---|---|---|---|
| EP | 2680613 | A2 | 1/2014 |
| EP | 2824942 | A1 | 1/2015 |
| EP | 2835862 | A1 | 2/2015 |
| EP | 3313096 | A1 | 4/2018 |

OTHER PUBLICATIONS

U.S. Appl. No. 16/057,177, filed Aug. 7, 2018, Shriner.

U.S. Appl. No. 16/173,836, filed Oct. 29, 2018, Shriner et al.

Berge et al., "Tuning a Dual-Band Bowtie Slot Antenna with Parabolic Radiating Slots for the 900 MHz and 2400 MHz Bands", 6th European Conference on Antennas and Propagation, Mar. 2012, pp. 2376-2379.

Fractus Antennas User Manual Micro Reach Xtend (FR05-S1-N-0-110), Nov. 2017, 12 pages.

Garje et al., "Single-Fee Triangular Slotted Microstrip Bowtie Antenna for Quad-bands Applications", IOSR Journal of Electronics and Communication Engineering, vol. 11, Issue 5, Ver. III, Sep.-Oct. 2016, pp. 22-27.

Mansoul et al., "Multiband reconfigurable Bowtie slot antenna using switchable slot extension for WiFi, WiMAX , and WLAN applications", Microw Opt Technol Lett; 60; 2018 pp. 413-418.

Murata et al., "Broadband Characteristics Analysis of Semicircle-Type Bow-tie Antenna with Hole Slots", Electrical Engineering in Japan, vol. 159, No. 4, 2007, pp. 47-53.

Murugaveni et al., "Design of Slotted Waveguide Antenna for Radar Applications at X-Band", International Journal of Engineering Research & Technology, vol. 3, Issue 11, Nov. 2014, pp. 426-428.

Extended European Search report from counterpart European Application No. 19178298.6, dated Mar. 19, 2020, 9 pp.

IEEE Std 145-1983, "IEEE Standard Definitions of Terms for Antennas", Jun. 22, 1983, 31 pp.

Response to European Search Report dated Mar. 19, 2020, from counterpart European Application No. 19178298.6, filed Oct. 12, 2020, 20 pp.

* cited by examiner

EAR-WORN ELECTRONIC DEVICE INCORPORATING CHIP ANTENNA LOADING OF ANTENNA STRUCTURE

TECHNICAL FIELD

The present application relates generally to antennas and specifically to antennas of ear-worn electronic devices, such as hearing devices, personal amplification devices, and other hearables.

BACKGROUND

Hearing devices provide sound for the wearer. Some examples of hearing devices are headsets, hearing aids, speakers, cochlear implants, bone conduction devices, and personal listening devices. Hearing devices may be capable of performing wireless communication with other devices. For example, hearing aids provide amplification to compensate for hearing loss by transmitting amplified sounds to their ear canals. The sounds may be detected from the wearer's environment using the microphone in a hearing aid and/or received from a streaming device via a wireless link. Wireless communication may also be performed for programming the hearing aid and receiving information from the hearing aid. For performing such wireless communication, hearing devices such as hearing aids may each include a wireless transceiver and an antenna.

Some hearing devices, such as hearing aids, are small and have limited space that restricts the size and location the antenna can occupy. Increasing the size of the antenna may not be practical or possible in some applications to achieve desirable wireless communication performance. Further, in addition to size constraints, the form factor of small hearing devices may limit the antenna design options to particular geometries. Such geometries may be complex to design and may rely upon exotic materials, which can be expensive and time-intensive to design and manufacture.

There is a need for antennas with improved wireless communication performance that may be designed and manufactured at a reasonable cost.

SUMMARY

Various aspects of the present disclosure relate to an antenna structure including a chip antenna. The chip antenna may be used to simultaneously contribute to antenna radiation and to load the antenna structure. The chip antenna may be coupled to one or two antenna elements that contribute to antenna radiation. In some embodiments, in contrast to conventional uses, the chip antenna is not operably coupled to a large ground plane.

In one aspect, the present disclosure relates to an ear-worn electronic device configured to be worn by a wearer. The device includes an enclosure configured to be supported by or in an ear of the wearer. The device also includes electronic circuitry disposed in the enclosure and including a wireless transceiver. The device further includes an antenna in or on the enclosure and operably coupled to the wireless transceiver. The antenna includes a first antenna element; a second antenna element; and a chip antenna operably coupled to the first and second antenna elements.

In one aspect, the present disclosure relates to an ear-worn electronic device configured to be worn by a wearer. The device includes an enclosure configured to be supported by or in an ear of the wearer. The device also includes electronic circuitry disposed in the enclosure and including a wireless transceiver. The device further includes an antenna in or on the enclosure. The antenna includes a first antenna element having a first side and an opposing second side. The first side is connected to a first feed line conductor. The antenna also includes a second antenna element having a first side and an opposing second side. The first side of the second antenna element is connected to a second feed line conductor. The first and second feed line conductors are coupled to the wireless transceiver. The antenna further includes a strap connected to the second side of the first antenna element and the second side of the second antenna element. The strap includes a chip antenna.

In one aspect, the present disclosure relates to an electronic device including a wireless transceiver an antenna operably coupled to the wireless transceiver. The antenna includes a first antenna element; a second antenna element; and a chip antenna without a ground plane operably coupled to the first and second antenna elements and configured to radiate with the first and second antenna elements and reactively load the antenna.

In one or more aspects, the chip antenna is tuned to a frequency in a range from 2.4 up to 2.5 GHz.

In one or more aspects, the chip antenna includes a plurality of alternating layers, including meandering conductor layers alternating with dielectric layers.

In one or more aspects, the chip antenna has an impedance having a real component configured to radiate an electric field and a reactive component configured to tune the antenna.

In one or more aspects, the device further includes a reactive component coupled between the first and second antenna elements.

In one or more aspects, the reactive component includes at least one of a capacitor and an inductor.

In one or more aspects, the reactive component includes at least one of an interdigitated capacitor, an L-C network, or an RLC network.

In one or more aspects, the reactive component includes at least one of a distributed component or a shaped region that functions as the reactive component.

In one or more aspects, the antenna includes a strap between the first and second antenna elements.

In one or more aspects, the chip antenna includes a surface mounted component disposed on the strap.

In one or more aspects, the device further includes at least one chip antenna disposed on the first antenna element and at least one chip antenna disposed on the second antenna element to balance loading of the antenna elements.

In one or more aspects, the device further includes a matching network disposed between the wireless transceiver and feed conductors of the antenna, wherein the matching network is configured to substantially cancel a reactance of the antenna at the feed conductors that is modified by a reactance of the chip antenna.

In one or more aspects, the antenna includes the first antenna element, the second antenna element, and one or more additional antenna elements; and one or more of chip antennas are coupled between the first, second, and the one or more additional antenna elements.

In one or more aspects, the antenna is configured as a bowtie antenna.

BRIEF DESCRIPTION OF THE DRAWINGS

Various embodiments of this application are illustrated in the drawings as follows.

DETAILED DESCRIPTION

Figure 1:
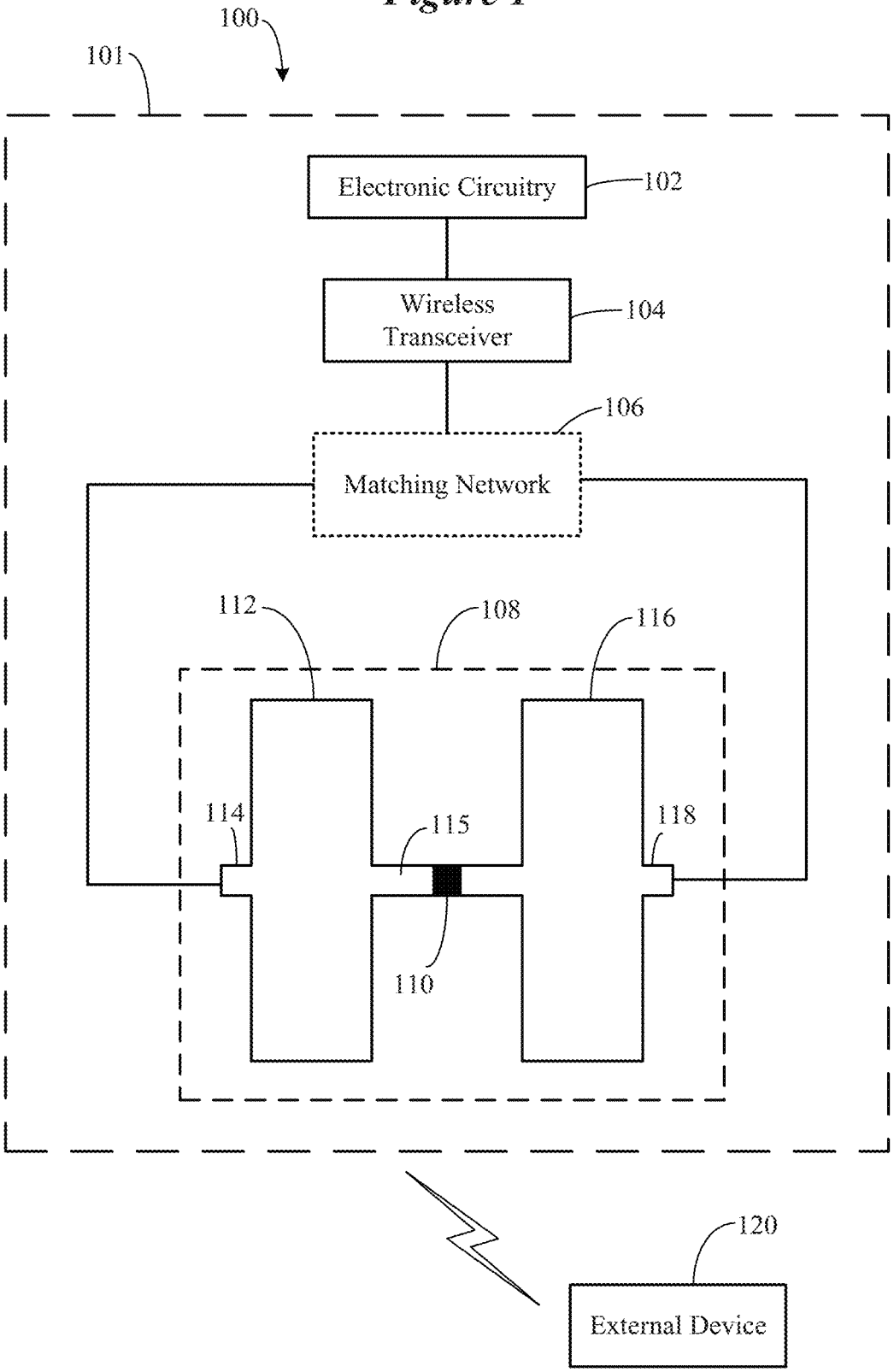
FIG. 1 illustrates an ear-worn electronic device configured to be worn in accordance with various embodiments.

This disclosure relates to an antenna for an ear-worn device. Although reference is made herein to hearing devices, such as a hearing aid, the antenna may be used with any electronic device using wireless communications, particularly small devices positioned near the ear or other human anatomy. Non-limiting examples of rechargeable devices include hearing aids, hearable devices (for example, earbuds, Bluetooth® headsets, or back-vented vented tweeter-woofer devices), wearables or health monitors (for example, step counter or heartrate monitor), or other portable or personal electronics (for example, smartwatch or smartphone). Various other applications will become apparent to one of ordinary skill in the art having the benefit of this disclosure.

It may be beneficial to provide an antenna that performs sufficiently for wireless communications while maintaining a small size. It may also be beneficial to provide an antenna configured to facilitate a sufficient wireless communication range for ear-worn device applications. Further, it may be beneficial to provide an antenna design that is cost-effective to design and manufacture.

The present disclosure provides an antenna structure including a chip antenna. The chip antenna may be used to simultaneously contribute to antenna radiation and to load the antenna structure. The chip antenna may be coupled to one or two antenna elements that contribute to antenna radiation. In some embodiments, in contrast to conventional uses, the chip antenna is not operably coupled to a large ground plane. In other words, the antenna structure may include only part of a conventional chip antenna design. In some embodiments, the antenna structure is made according to a differential antenna design, such as a bowtie antenna design including two antenna elements. One or more chip antennas may be positioned on a strap between two antenna elements. One or more chip antennas may be positioned on each of the antenna elements themselves, which may facilitate balancing the load of each antenna element. The antenna structure may further include one or more reactive components, such as a capacitor or inductor. The chip antenna may be used as one of the reactive components.

Advantageously, antenna structures according to this application may improve antenna efficiency, gain, and thus total radiated power (TRP) while maintaining a small antenna size by using the chip antenna to radiate and circuit match. Using the chip antenna to increase input resistance of the antenna may facilitate the ease-of-design of a matching network. The antenna structures may not use large ground planes that are typically part of conventional chip antenna designs, which further facilitates the small antenna size. This efficient antenna structure may radiate sufficiently such that heating around the antenna or other nearby objects (e.g., human body) is reduced, wireless communication range is improved, and design and manufacture is cost effective.

All scientific and technical terms used herein have meanings commonly used in the art unless otherwise specified. Any definitions provided herein are to facilitate understanding of certain terms used frequently herein and are not meant to limit the scope of the present disclosure.

As used herein, the term "ground plane" refers to an electrically conductive surface, usually connected to electrical ground. In antenna theory, a ground plane may refer to a conducting surface that is large in comparison to the signal wavelength for transmission and is connected to the transmitter's ground wire and serves as a reflecting surface for radio waves. In printed circuit boards, a ground plane may refer to a large area of copper foil on the board which is connected to the power supply ground terminal and serves as a return path for current from different components on the board. In general, the definition of ground plane used herein excludes antenna elements, which are not large compared to signal wavelength for transmission or connected to electrical ground. For example, the wavelength of a 2.45 GHz signal is 122.45 mm (about 4.8 inches). The longest dimension of ear-worn electronic devices according to the present disclosure may be less than 5, 4, 3, 2, or 1 inch.

Ear-worn electronic devices, such as hearables (e.g., wearable earphones, ear monitors, and earbuds), hearing aids, and hearing assistance devices, typically include an enclosure, such as a housing or shell, within which internal components are disposed. Typical components of an ear-worn electronic device can include a digital signal processor (DSP), memory, power management circuitry, one or more communication devices (e.g., a radio, a near-field magnetic induction (NFMI) device), one or more antennas, one or more microphones, and a receiver/speaker, for example. Ear-worn electronic devices can incorporate a long-range communication device, such as a Bluetooth® transceiver or other type of radio frequency (RF) transceiver. A communication device (e.g., a radio or NFMI device) of an ear-worn electronic device can be configured to facilitate communication between a left ear device and a right ear device of the ear-worn electronic device.

Ear-worn electronic devices of the present disclosure can incorporate an antenna arrangement coupled to a high-frequency radio, such as a 2.4 GHz radio. The radio can conform to an IEEE 802.11 (e.g., WiFi®) or Bluetooth® (e.g., Bluetooth® Low Energy (BLE), Bluetooth® 4.2 or 5.0) specification, for example. It is understood that hearing devices of the present disclosure can employ other radios, such as a 900 MHz radio. Ear-worn electronic devices of the present disclosure can be configured to receive streaming audio (e.g., digital audio data or files) from an electronic or digital source. Representative electronic/digital sources (e.g., accessory devices) include an assistive listening system, a TV streamer, a radio, a smartphone, a laptop, a cell phone/entertainment device (CPED) or other electronic device that serves as a source of digital audio data or other types of data files. Ear-worn electronic devices of the present disclosure can be configured to effect bi-directional communication (e.g., wireless communication) of data with an external source, such as a remote server via the Internet or other communication infrastructure.

The term ear-worn electronic device of the present disclosure refers to a wide variety of ear-level electronic devices that can aid a person with impaired hearing. The term ear-worn electronic device also refers to a wide variety of devices that can produce optimized or processed sound for persons with normal hearing. Ear-worn electronic devices of the present disclosure include hearables (e.g., wearable earphones, headphones, earbuds, virtual reality headsets), hearing aids (e.g., hearing instruments), cochlear implants, and bone-conduction devices, for example. Ear-worn electronic devices include, but are not limited to, behind-the-ear (BTE), in-the-ear (ITE), in-the-canal (ITC), invisible-in-canal (IIC), receiver-in-canal (RIC), receiver-in-the-ear (RITE) or completely-in-the-canal (CIC) type hearing devices or some combination of the above. Throughout this disclosure, reference is made to an "ear-worn device" or "ear-worn electronic device," which are understood to refer to a system including one of a left ear device and a right ear device or a combination of a left ear device and a right ear device.

Reference will now be made to the drawings, which depict one or more aspects described in this disclosure. However, it will be understood that other aspects not depicted in the drawings fall within the scope of this disclosure. Like numbers used in the figures refer to like components, steps, and the like. However, it will be understood that the use of a reference character to refer to an element in a given figure is not intended to limit the element in another figure labeled with the same reference character. In addition, the use of different reference characters to refer to elements in different figures is not intended to indicate that the differently referenced elements cannot be the same or similar.

FIG. 1 illustrates an ear-worn electronic device configured to be worn by a wearer in accordance with various embodiments. The ear-worn electronic device 100 includes an enclosure 101, such as a shell, configured to be supported by or in an ear of the wearer. The ear-worn electronic device 100 includes electronic circuitry 102 disposed in the enclosure 101 and includes a wireless transceiver 104. An antenna 108 is situated in or on the enclosure 101 and coupled to the wireless transceiver 104. In some embodiments, a matching network 106 is coupled between the antenna 108 and the wireless transceiver 104. As shown, the matching network 106 is coupled to feed line conductors 114 and 118 of the antenna 108. In other embodiments, the matching network 106 is not needed (e.g., no matching network is attached to the antenna feed line conductors).

As used herein, the term "antenna structure" refers to the antenna 108 and components operably coupled to the antenna 108 that contribute to radiating. For example, the antenna structure may include the antenna 108, the matching network 106, and the wireless transceiver 104.

In general terms, a matching network is a type of electronic circuit that is designed to be mounted between a radio (e.g., radio chip) and the antenna feed. A radio chip is different than a chip antenna, which will be described herein in more detail. In principle, these electronic circuits should match the radio output impedance to the antenna input impedance (or match the radio input impedance to the antenna output impedance when in a receive mode) for maximum power transfer. In accordance with embodiments of the disclosure, a reactively loaded network circuit is placed on the antenna structure itself, rather than at the antenna feed point. Unlike a traditional matching network, a reactively loaded network circuit placed on the antenna structure enhances the antenna radiation properties in addition to reducing the impedance mismatch factor. This yields much better performance in terms of the antenna efficiency. The reactively loaded network circuit includes a chip antenna, which may radiate and reduce the impedance mismatch factor. The reactively loaded network circuit may include other reactive components that reduce the impedance mismatch factor but do not radiate, such as capacitors and inductors. In some embodiments, inclusion of a reactively loaded network circuit placed on the antenna structure provides for the elimination of a matching network between the radio and the antenna feed point. In other embodiments, inclusion of a reactively loaded network circuit placed on the antenna structure provides for a reduction in the complexity (e.g., a reduced number of components) needed for impedance matching between the radio and the antenna feed point.

In the embodiment shown in FIG. 1, the antenna 108 includes a first antenna element 112 and a second antenna element 116. It is noted that the antenna 108 shown in FIG. 1 is in a flattened state for illustrative purposes. Typically, the antenna 108 is a folded structure (e.g., see FIG. 3A), such that a gap is formed between the two roughly parallel first and second antenna elements 112 and 116. The first and second antenna elements 112 and 116 can be formed from conductive plates that can be shaped to fit within the enclosure 101. In some embodiments, the first and second antenna elements 112 and 116 include stamped metal plates. In other embodiments, the first and second antenna elements 112 and 116 include plastic plates that support a metallization layer(s) (e.g., by use of a Laser Direct Structuring (LDS) technique). In further embodiments, the first and second antenna elements 112 and 116 are implemented as flex circuits within the enclosure 101 (e.g., outer shell) of the ear-worn electronic device.

As is shown in FIG. 1, a reactive component 110 including a chip antenna is coupled between the first and second antenna elements 112 and 116. More particularly, the first and second antenna elements 112 and 116 are connected together by a conductive strap 115. In some embodiments, the reactive component 110 includes a passive electrical component (e.g., lumped or discrete component) mounted to the strap 115. In other embodiments, the reactive component 110 includes a distributed electrical component including multiple passive electrical components. In further embodiments, a shaped portion of the strap 115 functions as a distributed reactive component 110. It is noted that the strap 115 can be a flattened planar member formed from a metal or a metalized flattened planar member formed from plastic. In some embodiments, the strap 115 can be a wire that connects the reactive component 110 to each of the first and second antenna elements 112 and 116.

In the embodiment illustrated in FIG. 1, two antenna elements 112 and 116 and a reactive component 110 are shown. It is understood that an ear-worn electronic device can incorporate three or more antenna elements with one or more impedance networks connecting the three or more antenna elements.

According to various embodiments, the antenna 108 is configured as a bowtie antenna. Bowtie antennas are also generally known as dipole broadband antennas and can be referred to as "butterfly" antennas or "biconical" antennas. In general, a bowtie antenna can include two roughly parallel conductive plates that can be fed at a gap between the two conductive plates. Examples of the bowtie antenna that may be used in hearing aids are described in U.S. patent application Ser. No. 14/706,173, entitled "HEARING AID BOWTIE ANTENNA OPTIMIZED FOR EAR TO EAR COMMUNICATIONS", filed on May 7, 2015, and in U.S. patent application Ser. No. 15/331,077, entitled "HEARING DEVICE WITH BOWTIE ANTENNA OPTIMIZED FOR SPECIFIC BAND, filed on Oct. 21, 2016, which are commonly assigned to Starkey Laboratories, Inc., and incorporated herein by reference in their entirety. It is understood that antennas other than bowtie antennas can be implemented to include an on-antenna reactively loaded network circuit in accordance with embodiments of the disclosure. Such antennas include any antenna structure that includes two or more somewhat independent portions that may be loaded with elements connecting at least two or more of these portions. Representative antennas include dipoles, monopoles, dipoles with capacitive-hats, monopoles with capacitive-hats, folded dipoles or monopoles, meandered dipoles or monopoles, loop antennas, yagi-uda antennas, log-periodic antennas, slot antennas, inverted-F antennas (IFA), planer inverted-F antennas (PIFA), rectangular microstrip (patch) antennas, and spiral antennas.

Antennas with low efficiency are typically poor radiators. Designing antennas with high efficiency for ear-worn electronic devices, such as hearing aids for example, may be a very challenging task. When used in an electronic device that is to be worn on or in a wearer's head, the impedance of the antenna can be substantially affected by the presence of human tissue, which degrades the antenna performance. Such effect is known as "head loading" and can make the performance of the antenna when the electronic device is worn (referred to as "on head performance") substantially different from the performance of the antenna when the electronic device is not worn. Impedance of the antenna including effects of head loading depends on the configuration and placement of the antenna, which are constrained by size and placement of other components of the ear-worn electronic device.

Performance of an antenna in wireless communication, such as its radiation efficiency, depends on impedance matching between the feed point of the antenna and the output of the communication circuit such as a transceiver. The impendence of the antenna is a function of the operating frequency of the wireless communication. The small physical size of the antenna of an ear-worn electronic device with respect to its operating frequency imposes significant physical constraints and limits the TRP of the antenna. Embodiments of the disclosure provide significant increase antenna TRP and improved impedance matching by incorporating a chip antenna in a reactively loaded network circuit on the antenna itself.

In various embodiments, the antenna shown in FIG. 1 and in other figures can allow for ear-to-ear communication with another ear-worn electronic device 100 worn by the same wearer. The antenna shown in FIG. 1 can also provide for communication with another device 120 capable of wireless communication with the ear-worn electronic device 100. The external device 120 can represent many different types of devices and systems, such as a programming device, a smartphone, a laptop, an audio streaming device, a device configured to send one or more types of notification to the wearer, and a device configured to allow the wearer to use the hearing device as a remote controller.

Figure 2A:
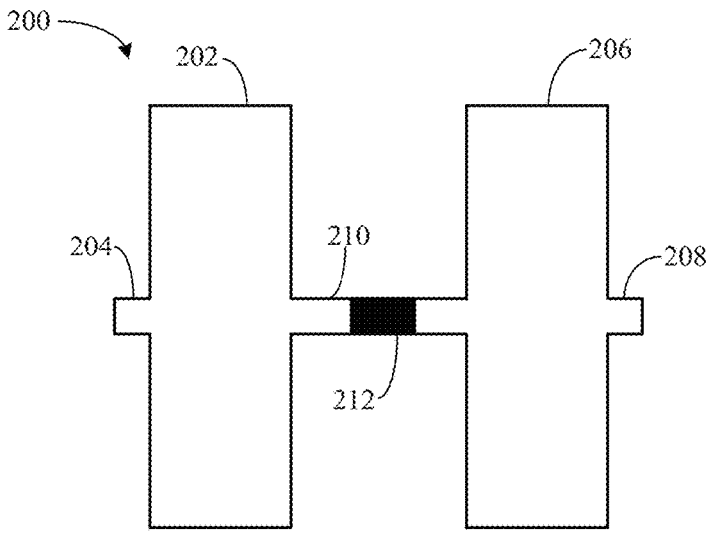
FIG. 2A shows a reactively loaded network circuit implemented on an antenna structure of an ear-worn electronic device in accordance with various embodiments.

FIG. 2A shows a reactively loaded network circuit implemented on an antenna structure of an ear-worn electronic device in accordance with various embodiments. As in the case of the embodiment shown in FIG. 1, the antenna 200 shown in FIG. 2A is illustrated in a flattened state. FIG. 2A shows an antenna 200 which includes a first antenna element 202 connected to a second antenna element 206 by a strap 210. The first antenna element 202 includes a feed line conductor 204, and the second antenna element 206 includes a feed line conductor 208. A reactive component 212 is shown mounted to or structurally integrated into the strap 210. The reactive component 212 mounted to or incorporated within the strap 210 defines a reactively loaded network circuit, which may be referred to as a distributed matching network. The antenna 200 which includes the reactive component 212 can be referred to as a loaded-antenna.

Figure 2B:
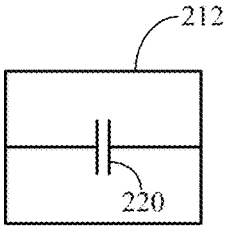
FIG. 2B shows the reactively loaded network circuit of FIG. 2A including a capacitor.
Figure 2D:
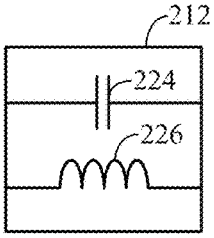
FIG. 2D shows the reactively loaded network circuit of FIG. 2A including a capacitor and an inductor.
Figure 2C:
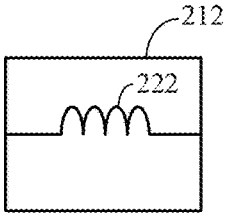
FIG. 2C shows the reactively loaded network circuit of FIG. 2A including an inductor.
Figure 2E:
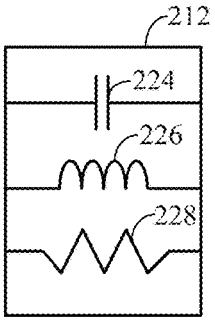
FIG. 2E shows the reactively loaded network circuit of FIG. 2A including a combination of a capacitor, an inductor, and a resistor.

According to some embodiments, and as shown in FIG. 2B, the reactive component 212 includes a capacitor 220. In other embodiments, as shown in FIG. 2C, the reactive component 212 includes an inductor 222. In further embodiments, as shown in FIG. 2D, the reactive component 212 includes a capacitor 224 and an inductor 226, coupled in parallel or series (e.g., arranged to form a parallel or series L-C network). In other embodiments, as shown in FIG. 2E, the reactive component 212 includes a capacitor 224, an inductor 226, and a resistor 228. The components shown in FIG. 2E can be arranged to form a series RLC network or a parallel RLC network. In some embodiments, the reactive component 212 includes a surface mount component or components.

Figure 2F:
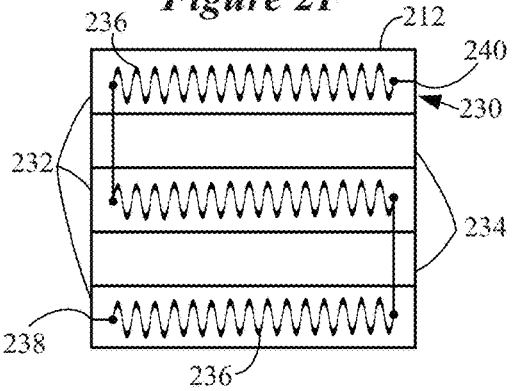
FIG. 2F shows the reactively loaded network circuit of FIG. 2A including a chip antenna.

As shown in FIG. 2F, the reactive component 212 includes a chip antenna 230, which may radiate with the antenna elements 202, 206 and contribute to the reactively loaded network. In some embodiments, the chip antenna 230 may be used in combination with other reactive components 212, such as the inductor 222, the capacitor 224, and the resistor 228. In some embodiments, only one chip antenna 230 is included coupled to the strap 210. In other embodiments, more than one chip antenna 230 is included. The chip antenna 230 may be configured to radiate with the first and second antenna elements and reactively load the antenna.

It was found by the inventors that incorporating the chip antenna 230 in the reactive component 212 in the antenna structure itself significantly improved the radiation efficiency of the antenna 200. As is discussed in detail herein, the total radiated power of the antenna 200 can be increased significantly by adding the chip antenna 230 reactive component 212 to the antenna structure itself. This improvement in antenna performance results from a change in the current flow through the antenna 200 and radiation contribution from the chip antenna 230.

The RF current flow in an antenna is a function of location and physics. Different voltage differences also exist between the two antenna portions at different physical locations. Introducing the correct impedance across the two antenna elements at specific locations causes current to flow between the two connected antenna portions. The amount of current depends on the magnitude and phase of the connecting impedance relative to the antenna portions differential source impedance and voltage at the connection points. The amount and phase of current is chosen to optimize either antenna efficiency, antenna feed-point impedance, or both.

In general, chip antennas are antenna components that are compact in size, which may offer surface mounted device (SMD) manufacturability in a standard or small form factor. Chip antennas may be good candidates for hearing aid (HA) applications that use the BLE band. However, chip antennas suffer from a major drawback in that, in order to function properly, a big ground plane is used to facilitate radiation from the chip antenna. A large ground plane may be impractical or undesirable for HAs, which have even more limited space than a smartphone. Using such antennas without a big ground plane is typically expected to result in poor performance and low efficiency. The present disclosure proposes using chip antennas along with other antennas used for HAs, such as bowtie antennas. The chip antenna 230 is used to load the bowtie antenna to create more area for the surface current to distribute, increasing the antenna's gain. Loading the bowtie antenna with the chip antenna 230 may enhance the antenna's radiation properties while maintaining a small size. Compared to using other reactive components 212 only, including or using the chip antenna 230 may provide an antenna structure with even smaller sizes and more efficient radiation. This type of combined antenna is may also be used in various wireless applications other than HAs.

Chip antennas are different from reactive components, for example, in that chip antennas radiate with the antenna structure to contribute to the generated electric field. Reactive components, such as inductors and capacitors, do not radiate. The real component of the chip antenna impedance may radiate an electric field, and the reactive component of the chip antenna impedance may be used to tune, or match with, the antenna structure. In contrast, for other reactive components, the real component of impedance may be lost as heat instead of radiation.

As used herein, the term "chip antenna" refers to a device including a plurality of layers. The plurality of layers includes at least a plurality of meandering conductor layers 232 and a plurality of alternating dielectric layers 234. The meandering conductor layers 232 may alternate with the dielectric layers 234. The meandering conductors 236 within each meandering conductor layer may be electrically coupled to one another. The chip antenna 230 may include two terminals 238, 240 electrically coupled to opposite ends of the meandering conductors 236. In some embodiments, a capacitor with similar matching capabilities as a chip antenna would be physically larger and require more space in the ear-worn device. The dielectric material may be selected to tune the chip antenna to a particular frequency range, such as a Bluetooth® frequency range from 2.4 up to 2.5 GHz.

Figure 3A:
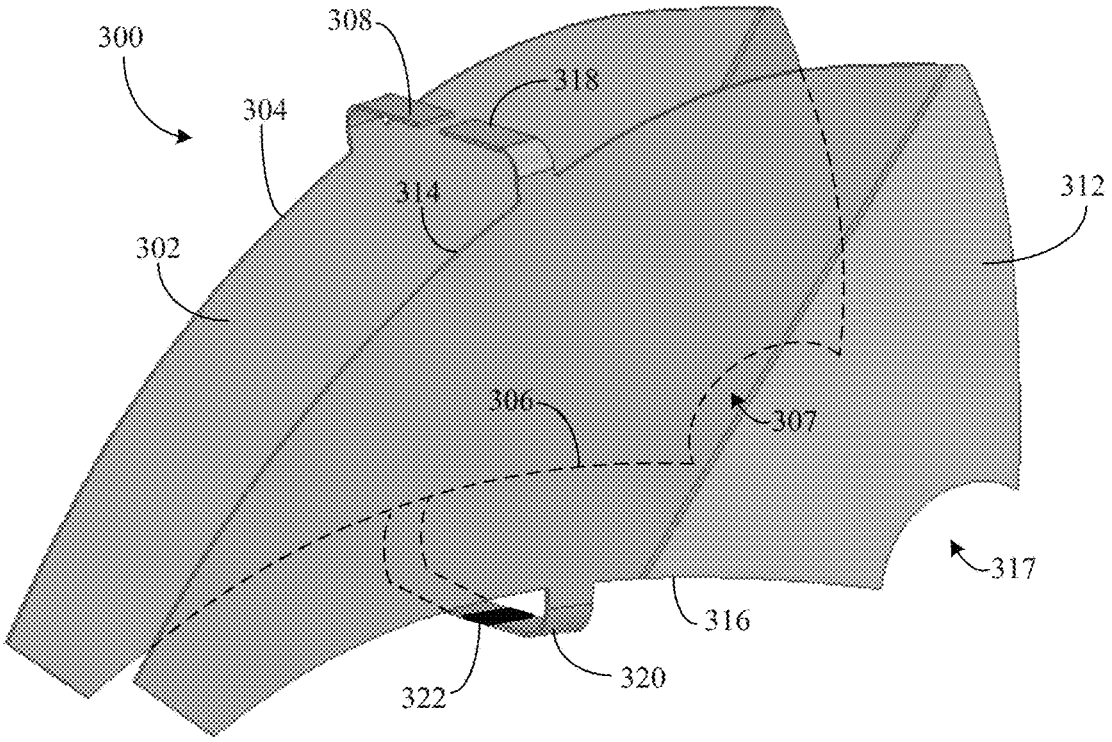
FIGS. 3A and 3B show a bowtie antenna which incorporates a reactively loaded network circuit in accordance with various embodiments.
Figure 3B:
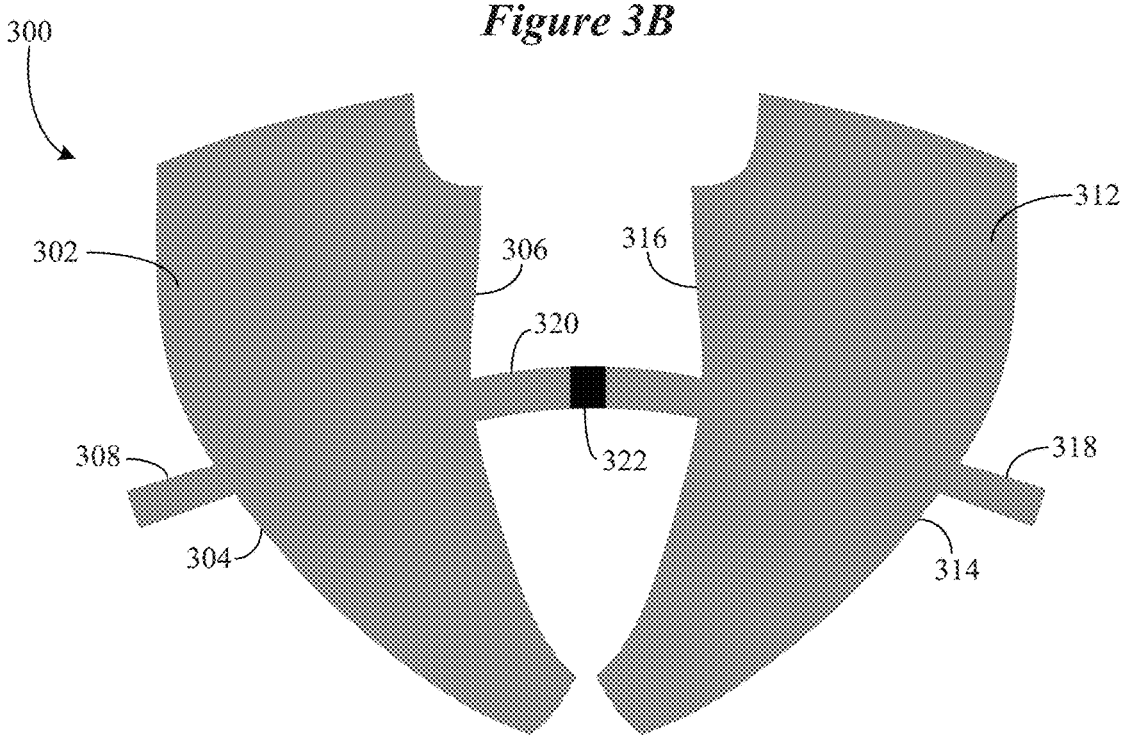

FIGS. 3A and 3B show a bowtie antenna 300 which incorporates a reactively loaded network circuit in accordance with various embodiments. In FIG. 3A, the antenna 300 is shown in an orientation as installed in an ear-worn electronic device. FIG. 3B shows the antenna 300 in a flattened state. The antenna 300 includes a first antenna element 302 having a first side 304 and an opposing second side 306. The first side 304 of the first antenna element 302 is connected to a first feed line conductor 308. The antenna 300 includes a second antenna element 312 having a first side 314 and an opposing second side 316. The first side 314 of the second antenna element 312 is connected to a second feed line conductor 318.

When installed in an ear-worn electronic device, the first and second antenna elements 302 and 312 are roughly parallel to one another. It is noted that the second sides 306 and 316 of the first and second antenna elements 302 and 312 include a notched region 307 and 317 to accommodate one or more components or structures of the ear-worn electronic device. In an installed configuration, the first and second feed line conductors 308 and 318 are coupled to a wireless transceiver, either directly or via a matching network.

A strap 320 connects the second side 306 of the first antenna element 302 to the second side 316 of the second antenna element 312. The strap 320 supports or incorporates a reactive component 322, which may include a chip antenna, a capacitor, an inductor, or the combination of these.

Various experiments were performed on a bowtie antenna of the type shown in FIGS. 3A and 3B to evaluate the performance of the antenna before and after incorporating a reactively loaded network circuit on the antenna itself. Two different configurations of the antenna 300 were used in the experiments. Impedance measurements were made for each of the left and right antenna elements 302 and 312. The total radiated power was measured with the antennas 300 placed in a Tesla chamber. It is noted that the TRP measurements were obtained using an industry-standard dummy head/torso phantom.

Antenna input impedance measurements (in ohm) for the two different antenna configurations were obtained at 2.45 GHz using a vector network analyzer (VNA) as standard measurement equipment. The real (R) and imaginary or reactive (X) parts of the antenna input impedance were measured and recorded for the antenna 300.

In a first configuration that was evaluated, the antenna 300 included a strap 320 but did not include a reactive component 322. A matching network was not used between the feed line conductors 308 and 318 of the antenna 300 and the radio chip. The impedance measurements for this first antenna configuration are given below in Table 1.

TABLE 1

| Impedance Measurements (ohm) @ 2.45 GHz | | | | |
|---|---|---|---|---|
| | Left | | Right | |
| | R | X | R | X |
| Average | 18.49 | 82.65333 | 21.25667 | 79.05667 |

The total radiated power (in dBm) for each of the left and right side of the head was measured and recorded at each of five different frequencies (2404, 2420, 2440, 2460, and 2478 MHz). The TRP measurements for this first antenna configuration are given below in Table 2. Table 2 includes the TRP measurements before and after use of a matching network (MN).

TABLE 2

| Frequency (MHz) | 2404 | 2420 | 2440 | 2460 | 2478 |
|---|---|---|---|---|---|
| Before MN-Left | −15.05903 | −15.4599 | −14.2215 | −11.4591 | −15.2309 |
| MN-Left | −9.869833 | −9.20686 | −10.2371 | −11.5317 | −10.4831 |
| Before MN-Right | −14.4433 | −14.6335 | −13.5734 | −10.5109 | −14.0559 |
| MN-Right | −9.31139 | −8.7079 | −10.1229 | −12.5494 | −9.97507 |

In a second configuration that was evaluated, the antenna 300 included a chip antenna as a reactive component 322 on the strap 320. In particular, the chip antenna was fabricated as a load across terminals of strap 320.

The antenna input impedance for this second antenna configuration was measured using a coaxial cable differential probe method and are given below in Table 3.

TABLE 3

| Impedance Measurements (ohm) @ 2.45 GHz | | |
|---|---|---|
| | Left & Right | |
| | R | X |
| Average | 20 | 89.45 |

A matching network was designed after collecting this antenna input impedance. The matching network was positioned between the radio chip and the antenna 300 for TRP measurements. The TRP measurements for this second antenna configuration was measured on an industry-standard human head/torso phantom in a standard antenna testing chamber from Satimo, and the TRP measurements are given below in Table 4 (in dBm). A human head/torso phantom

TABLE 4

| Frequency (MHz) | 2404 | 2420 | 2440 | 2460 | 2478 |
|---|---|---|---|---|---|
| Free Space | −6.91 | −6.94 | −6.7 | −8.39 | −8.12 |
| Left (dBm) | −7.44 | −7.94 | −8.41 | −8.29 | −8.82 |
| Right (dBm) | −7.00 | −7.68 | −8.38 | −8.91 | −8.4 |

The TRP measurement for the second antenna configuration is improved compared to traditional antennas for standard hearing aid (about −10 dBm). In general, the TRP measurements of the second antenna configuration are very high figures compared to many designed hearing aid antennas. The amount of power from the increased performance may be up to double that of some conventional antenna designs.

A method for designing an antenna structure may include: measuring input impedance of two or more antenna elements operably coupled to one or more chip antennas, designing a matching network to operably couple between an antenna element and a radio chip, and operably coupling the radio chip to the matching network, the antenna elements, and the chip antenna to provide an antenna structure. In some embodiments, the matching network is optional when the reactive impedance of the chip antenna is sufficient for matching.

Figure 4:
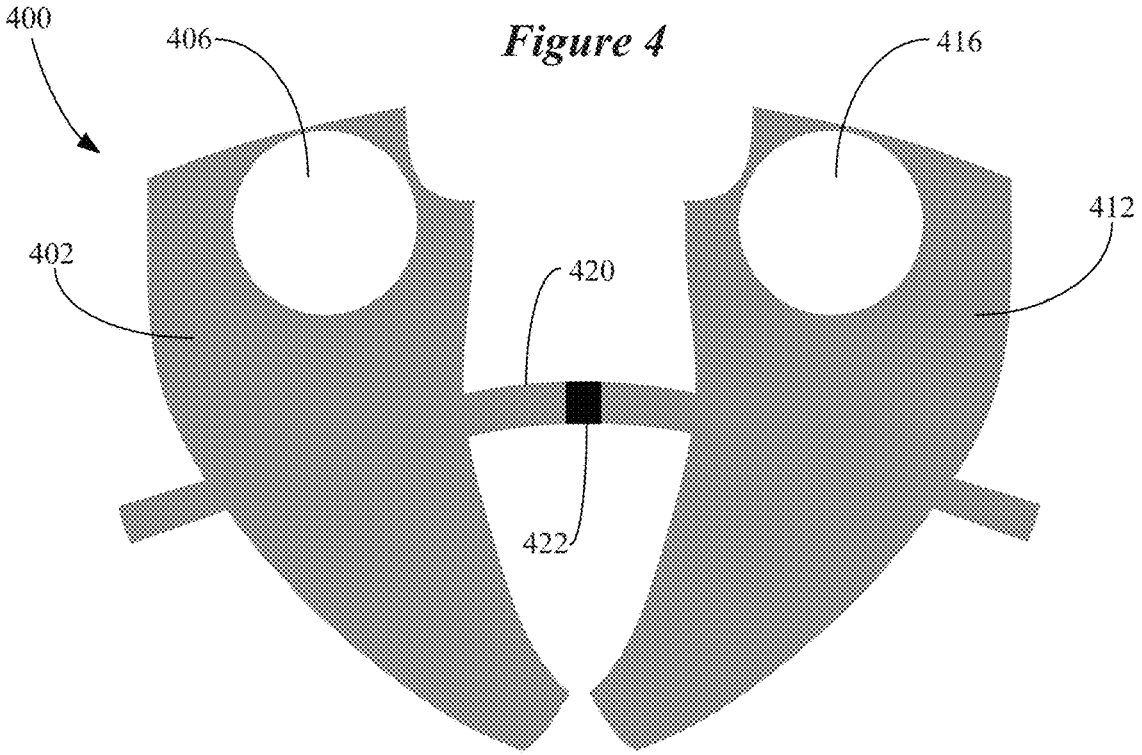
FIG. 4 illustrates an antenna including a reactively loaded network circuit in accordance with various embodiments.

FIG. 4 illustrates an antenna including a reactively loaded network circuit in accordance with various embodiments. The antenna 400 includes a first antenna element 402, a second antenna element 412, and a strap 420 connecting the first and second antenna elements 402 and 412. A reactive component 422 is mounted to or mechanically integrated into the strap 420. The reactive component 422 may include a chip antenna, a capacitor, an inductor, or combination of these. A wide region of the first and second antenna elements 402 and 412 includes a circular cutout 406 and 416. The cutouts 406 and 416 can be dimensioned to accommodate one or more components and/or structures of the ear-worn electronic device. For example, the circular cutouts 406 and 416 can be dimensioned to receive a battery of the ear-worn electronic device.

Figure 5:
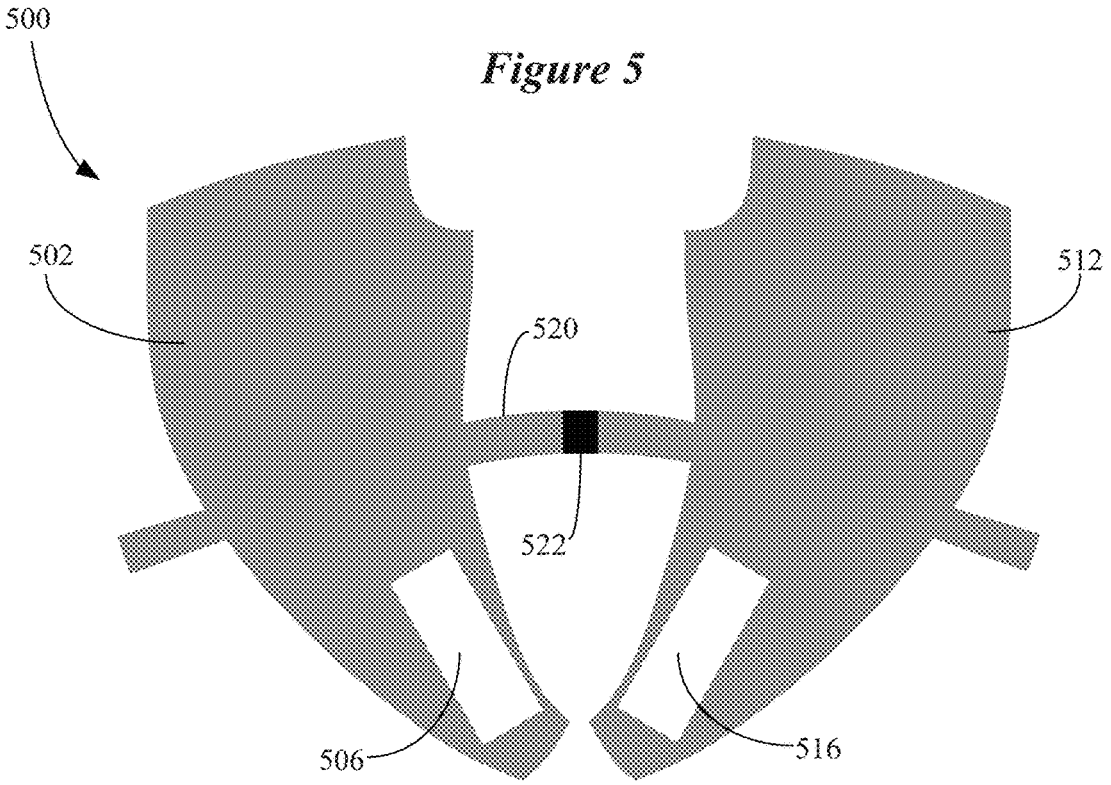
FIG. 5 illustrates an antenna including a reactively loaded network circuit in accordance with various embodiments.

FIG. 5 illustrates an antenna including a reactively loaded network circuit in accordance with other embodiments. The antenna 500 includes a first antenna element 502, a second antenna element 512, and a strap 520 connecting the first and second antenna elements 502 and 512. A reactive component 522 is mounted to or mechanically integrated into the strap 520. The reactive component 522 may include a chip antenna, a capacitor, an inductor, or the combination of these. A narrow region of the first and second antenna elements 502 and 512 includes a rectangular cutout 506 and 516. The cutouts 506 and 516 can be dimensioned to accommodate one or more components and/or structures of the ear-worn electronic device.

Figure 6A:
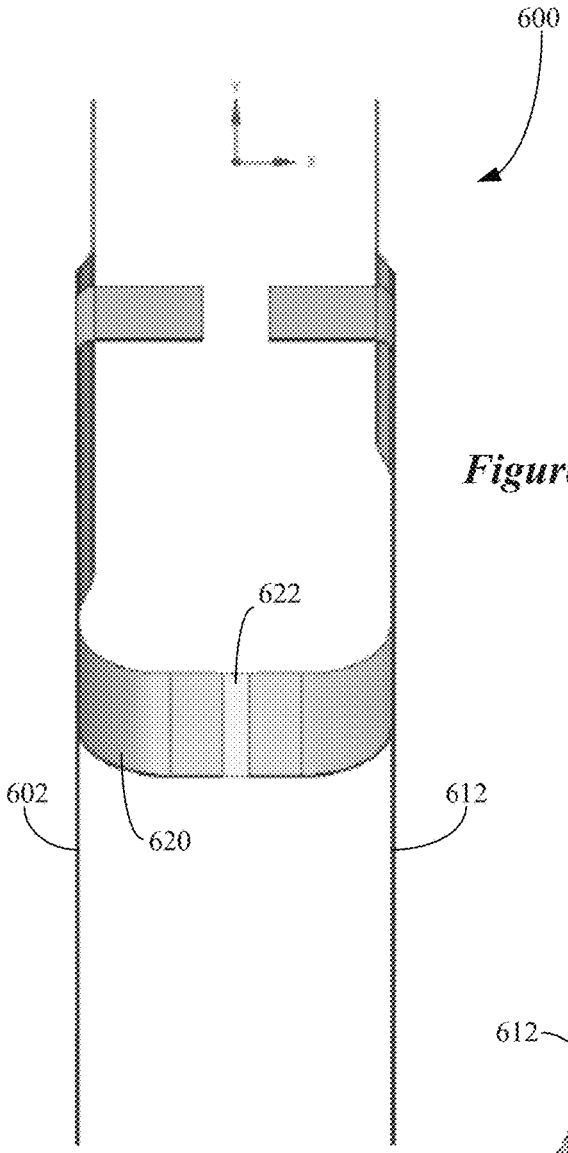
FIGS. 6A and 6B illustrate an antenna including a reactively loaded network circuit in accordance with various embodiments.
Figure 6B:
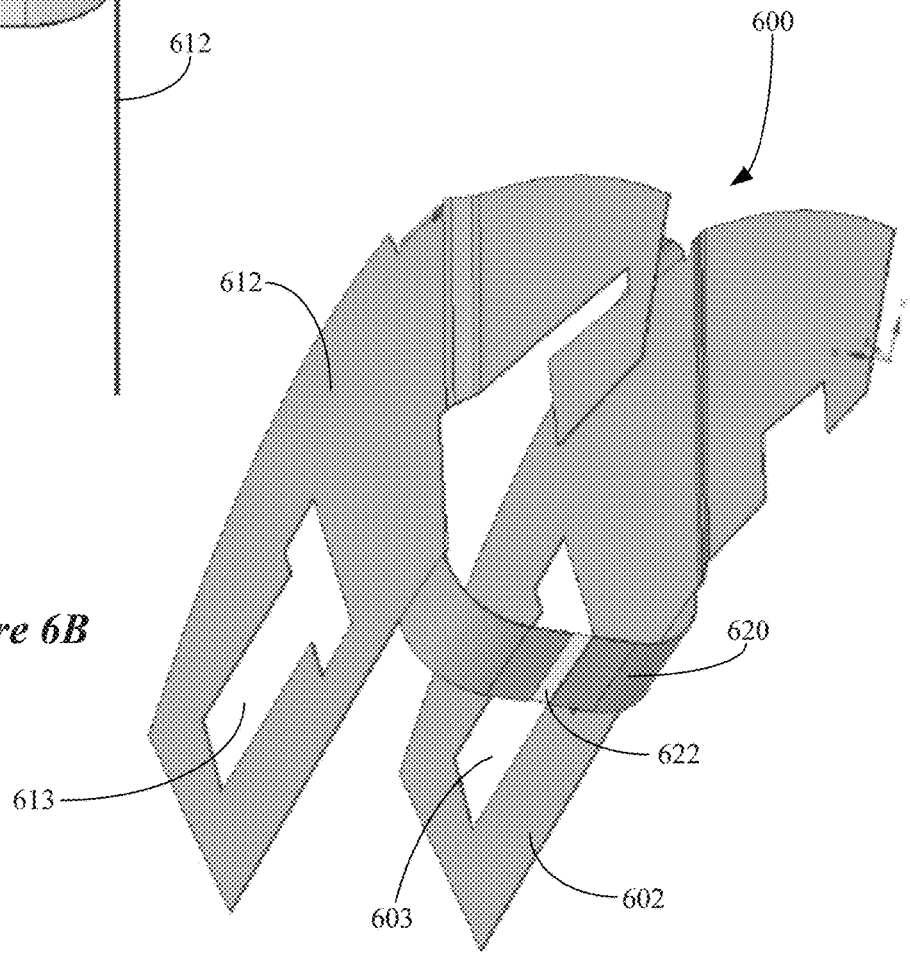

FIGS. 6A and 6B illustrate an antenna including a reactively loaded network circuit in accordance with other embodiments. The antenna 600 includes a first antenna element 602, a second antenna element 612, and a strap 620 connecting the first and second antenna elements 602 and 612. A reactive component 622 is mounted to the strap 620. The reactive component 622 may include a chip antenna, a capacitor, an inductor, or the combination of these. A narrow region of the first and second antenna elements 602 and 612 includes a T-shaped cutout 603 and 613. The cutouts 603 and 613 can be dimensioned to accommodate one or more components and/or structures of the ear-worn electronic device.

According to some embodiments, the antenna cutouts shown in FIGS. 4-6 (and other figures) can be shaped and positioned in the first and second antenna elements to help optimize performance of the antenna. For example, the antenna cutouts and/or notches can be configured (e.g., sized, shaped, and positioned in antenna elements) to help optimize performance of the antenna for one or more specified frequency bands. An example of the one or more specified frequency bands includes the 2.4 GHz Industrial Scientific Medical (ISM) radio band (e.g., with a frequency range of 2.4 GHz-2.5 GHz and a center frequency of 2.45 GHz). The introduction of one or more antenna cutouts and/or notches serves to modify the aperture of the antenna. The one or more antenna cutouts and/or notches can be configured to optimize (e.g., approximately maximize) a radiation efficiency of antenna. The one or more antenna cutouts and/or notches can be configured to optimize (e.g., approximately maximize) the impedance bandwidth of antenna, such as by providing a specified impedance bandwidth.

Figure 7A:
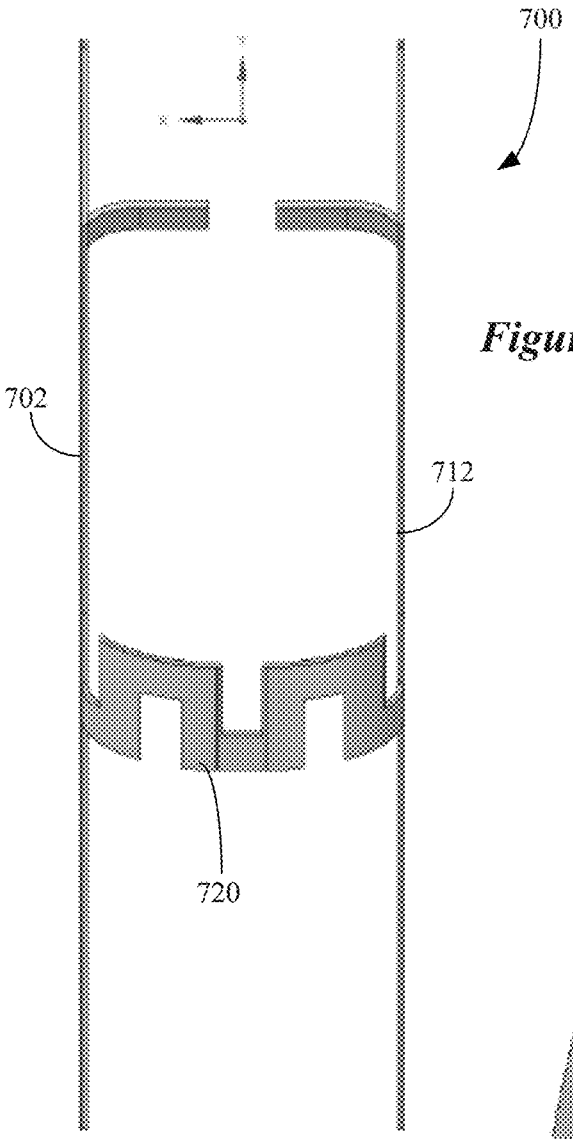
FIGS. 7A and 7B illustrate an antenna including a reactively loaded network circuit in accordance with various embodiments.
Figure 7B:
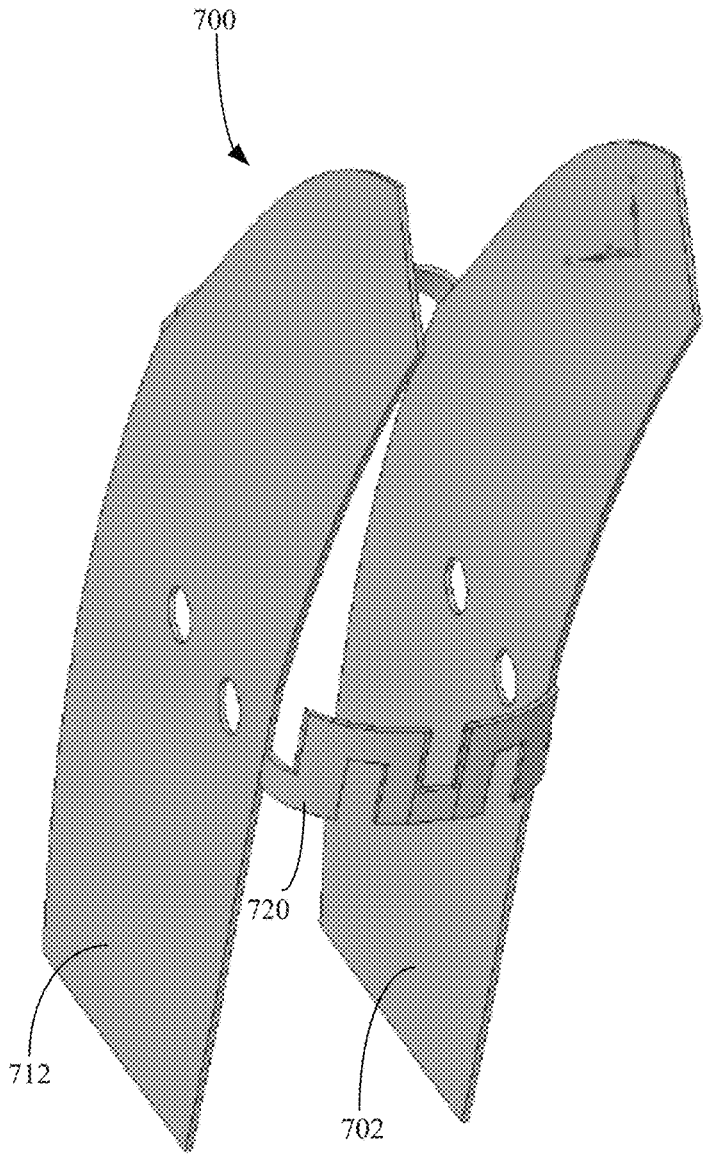

FIGS. 7A and 7B illustrate an antenna including a reactively loaded network circuit in accordance with other embodiments. The antenna 700 includes a first antenna element 702, a second antenna element 712, and a strap 720 connecting the first and second antenna elements 702 and 712. In the embodiment shown in FIGS. 7A and 7B, the strap 720 mechanically incorporates a reactive component 720. More particularly, a region of the strap 720 is shaped to function as an inductor. As shown, the strap 720 includes a region having a meandering (e.g., serpentine) shape which functions as an inductor. The mechanical attributes of the shaped region of the strap 720 (e.g., shape, size, thickness) can be modified to achieve a desired value of inductance.

Figure 8:
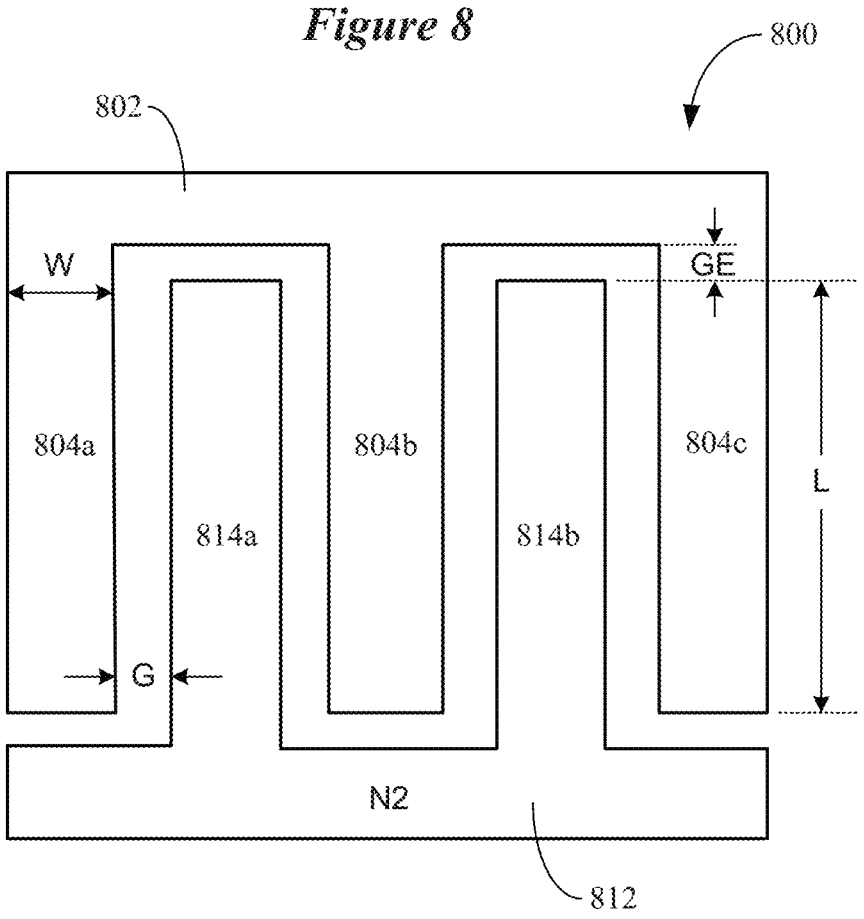
FIG. 8 illustrates an interdigitated capacitor that can serve as a reactive component of a reactively loaded network circuit in accordance with various embodiments.

According to some embodiments, a reactively loaded network circuit of the type discussed herein can incorporate an interdigitated capacitor, rather than a surface mount capacitor. FIG. 8 illustrates an interdigitated capacitor 800 that can be incorporated into the antenna structure (e.g., on the strap between first and second antenna elements) configured for use in an ear-worn electronic device in accordance with various embodiments. The interdigitated capacitor 800 includes a first electrode 802 from which three fingers 804*a*, 804*b*, and 804*c* extend. The interdigitated capacitor 800 also includes a second electrode 812 from which two fingers 814*a* and 814*b* extend. In this illustrative example, the interdigitated capacitor 800 has a total of five fingers 804/814. As is shown in FIG. 8, the fingers 804/814 of the first and second electrodes 802 and 812 are interleaved with one another. A gap, G, is formed between individual fingers 804/814. A space, GE, is defined at the end of each finger 804/814. Each of the fingers 804/814 has a width, W, and a length, L. It is noted that, when implemented on the antenna structure, the interdigitated capacitor 800 shown in FIG. 8 would include a substrate and a ground plane.

The parameters L, W, G, GE, and N (number of fingers) can be selected to achieve a desired capacitance. For example, optimized antenna performance may be achieved by incorporating a 1.2 pF capacitor between the first and second antenna elements of a bowtie antenna under evaluation. For the interdigitated capacitor 800 shown in FIG. 8, a 1.2 pF capacitor value can be achieved using the following parameter values: L=3.5 mm, W=5 mm, G=1 mm, GE=0.8 mm, and N=4.

Figure 9:
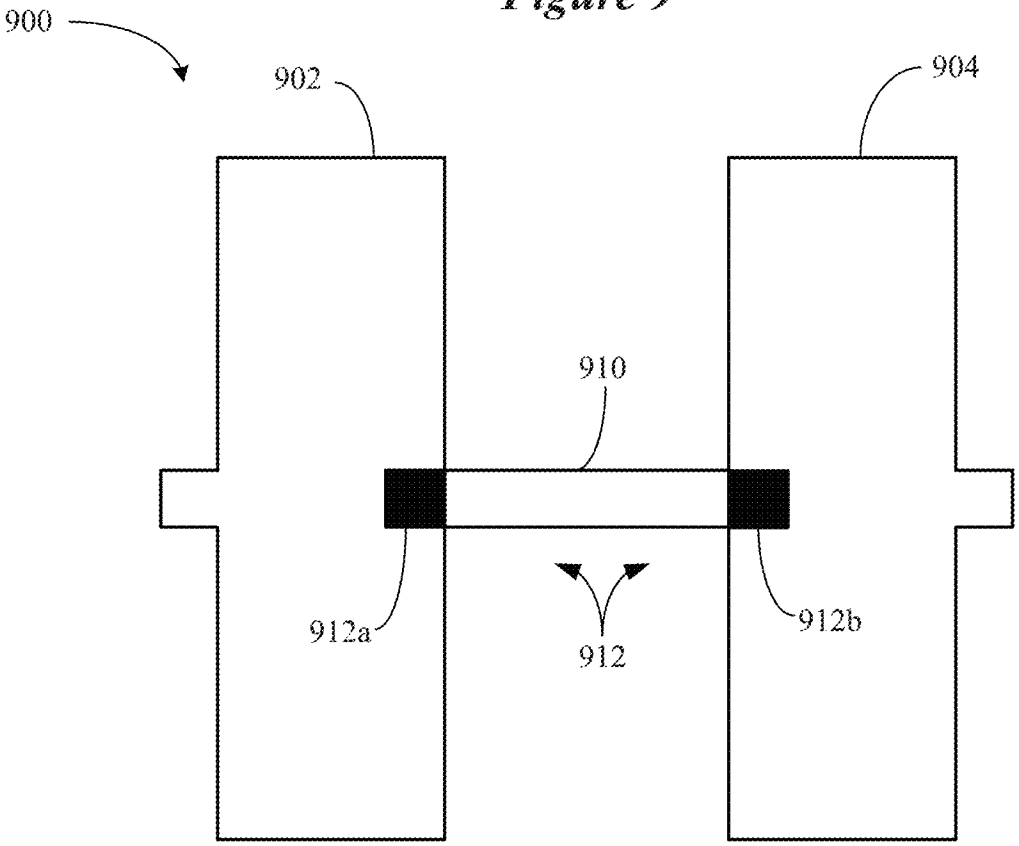
FIG. 9 shows a reactively loaded network circuit implemented on an antenna structure of an ear-worn electronic device in accordance with various embodiments.

FIG. 9 shows a reactively loaded network circuit implemented on an antenna structure of an ear-worn electronic device in accordance with various embodiments. The antenna 900 shown in FIG. 9 includes a first antenna element 902, a second antenna element 904, and a strap 910 connecting the first and second antenna elements 902 and 904. The antenna 900 further includes a distributed reactive component 912 including a first reactive component 912*a* and a second reactive component 912*b*. The first reactive component 912*a* is mounted on or connected to the first antenna element 902. The second reactive component 912*b* is mounted on or connected to the second antenna element 904. As shown, the first reactive component 912*a* is positioned on the first antenna element 902 at or adjacent a first end of the strap 910. The second reactive component 912*b* is positioned on the second antenna element 904 at or adjacent a second end of the strap 910. The first and second reactive components 912*a* and 912*b* can be chip antennas, capacitors, inductors, or the combination of these.

Figure 10:
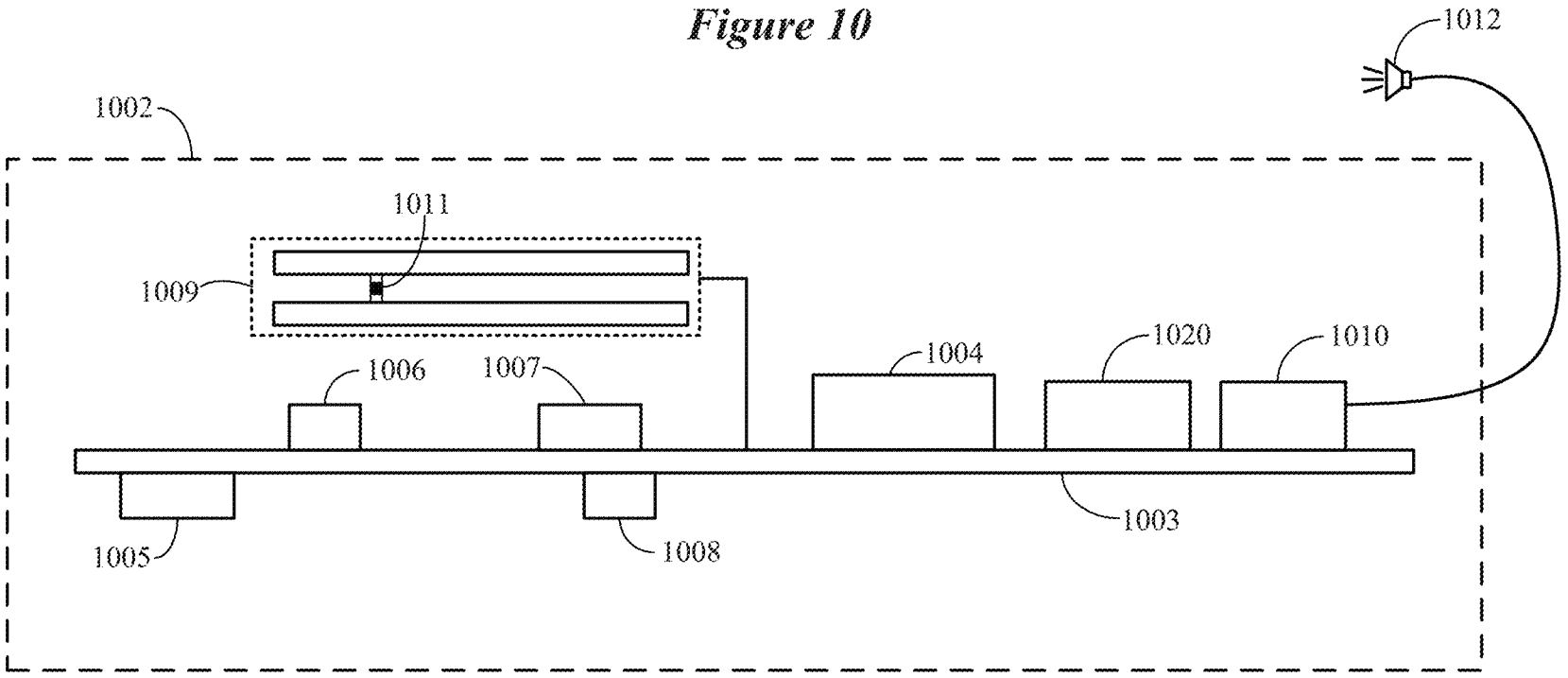
FIG. 10 is a block diagram showing various components of an ear-worn electronic device that can incorporate an antenna including a distributed reactively loaded network circuit on the antenna in accordance with various embodiments.

FIG. 10 is a block diagram showing various components of an ear-worn electronic device that can incorporate an antenna including a reactively loaded network circuit on the antenna in accordance with various embodiments. The block diagram of FIG. 10 represents a generic ear-worn electronic device 1002 for purposes of illustration. It is understood that the ear-worn electronic device 1002 may exclude some of the components shown in FIG. 10 and/or include additional components. It is also understood that the ear-worn electronic device 1002 illustrated in FIG. 10 can be either a right ear-worn device or a left ear-worn device. The components of the right and left ear-worn devices can be the same or different.

The ear-worn electronic device 1002 shown in FIG. 10 includes several components electrically connected to a mother flexible circuit 1003. A battery 1005 is electrically connected to the mother flexible circuit 1003 and provides power to the various components of the ear-worn electronic device 1002. One or more microphones 1006 are electrically connected to the mother flexible circuit 1003, which provides electrical communication between the microphones 1006 and a digital signal processor (DSP) 1004. Among other components, the DSP 1004 can incorporate or is coupled to audio signal processing circuitry. In some embodiments, a sensor arrangement 1020 (e.g., a physiologic or motion sensor) is coupled to the DSP 1004 via the mother flexible circuit 1003. One or more user switches 1008 (e.g., on/off, volume, mic directional settings) are electrically coupled to the DSP 1004 via the flexible mother circuit 1003.

An audio output device 1010 is electrically connected to the DSP 1004 via the flexible mother circuit 1003. In some embodiments, the audio output device 1010 includes a speaker (coupled to an amplifier). In other embodiments, the audio output device 1010 includes an amplifier coupled to an external receiver 1012 adapted for positioning within an ear of a wearer. The ear-worn electronic device 1002 may incorporate a communication device 1007 coupled to the flexible mother circuit 1003 and to an antenna 1009 directly or indirectly via the flexible mother circuit 1003. The antenna 1009 can be a bowtie antenna which includes a reactive component 1011 coupled to first and second antenna elements of the antenna 1009. The communication device 1007 can be a Bluetooth® transceiver, such as a BLE transceiver or another transceiver (e.g., an IEEE 802.11 compliant device). The communication device 1007 can be configured to communicate with one or more external devices, such as those discussed previously, in accordance with various embodiments.

Figure 12:
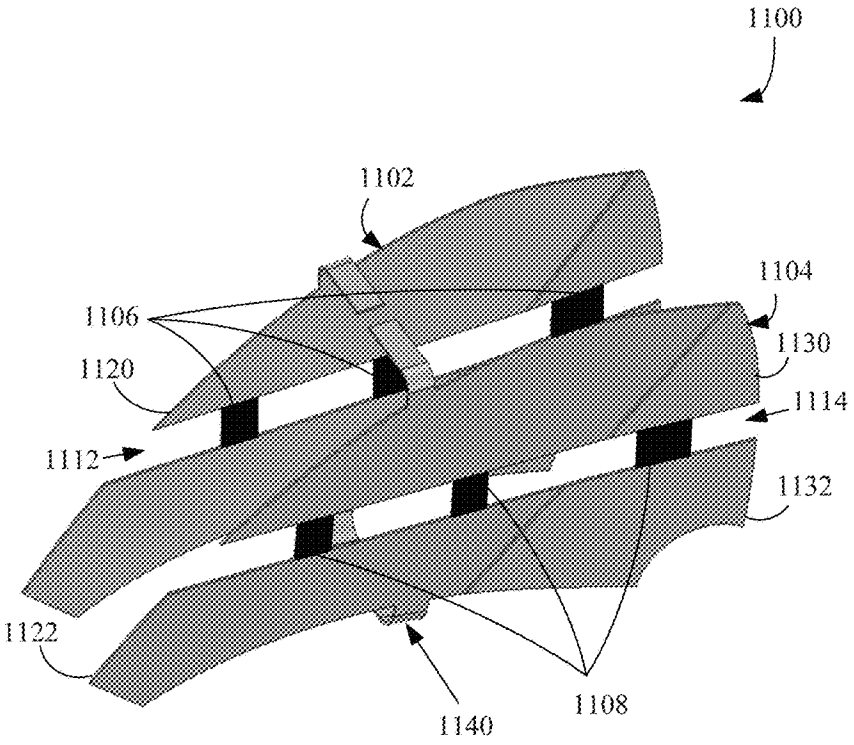
FIGS. 11 and 12 illustrate an antenna including cutouts and more than one chip antenna in accordance with various embodiments.
Figure 11:
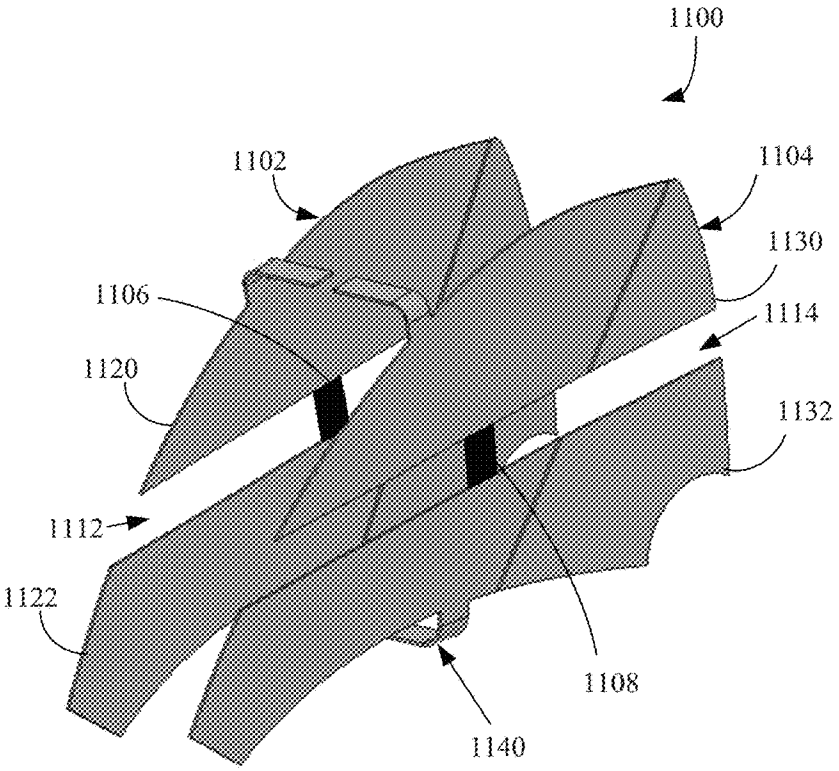

FIGS. 11 and 12 show an antenna structure 1100 according to a bowtie antenna design, which includes antenna elements 1102, 1104 that each have one or more chip antennas 1106, 1108. In particular, FIG. 11 shows one chip antenna 1106, 1108 on each antenna element 1102, 1104. FIG. 12 shows more than one chip antenna 1106, 1108 on each antenna element 1102, 1104 and, in particular, three chip antennas on each antenna element. Each of the chip antennas 1106, 1108 may be the same size or may have a different size than one or more of the other chip antennas. For example, one of the chip antennas 1106, 1108 may be larger than the others. Including chip antennas 1106, 1108 on each antenna element 1102, 1104 may provide a more balanced antenna design compared to using only a single chip antenna, for example, due to a more distributed current balance between the antenna elements.

The bowtie antenna design may be similar, for example, in overall shape and size to the one shown in FIG. 3A except that the antenna structure 1100 includes cutouts 1112, 1114. In the illustrated embodiments, each antenna element 1102, 1104 includes a cutout 1112, 1114. Each cutout 1112, 1114 may divide the respective antenna element 1102, 1104 into different portions. In particular, the first antenna element 1102 may include a first portion 1120 and a second portion 1122 separated by a cutout 1112, and the second antenna element 1104 may include a first portion 1130 and a second portion 1132 separated by a cutout 1114. One or more chip antennas 1106, 1108 may be positioned in the respective cutout 1112, 1114 between the respective first portion 1120, 1130 and respective second portion 1122, 1132.

Each cutout 1112, 1114 may extend entirely through the respective antenna element 1102, 1104 in a longitudinal direction along a length of the antenna structure 1100. Accordingly, the antenna elements 1102, 1104 may be described as being separated in a transverse direction, which may be orthogonal to the longitudinal direction. Each antenna element 1102, 1104 may include a strap 1140 extending between the second portions 1122, 1132. A structure similar to the strap 1140 may extend across the cutout 1112, 1114, and the chip antenna 1106, 1108 may be disposed on the strap-like structure.

Thus, various embodiments of the EAR-WORN ELECTRONIC DEVICE INCORPORATING CHIP ANTENNA LOADING OF ANTENNA STRUCTURE are disclosed. Although reference is made herein to the accompanying set of drawings that form part of this disclosure, one of at least ordinary skill in the art will appreciate that various adaptations and modifications of the embodiments described herein are within, or do not depart from, the scope of this disclosure. For example, aspects of the embodiments described herein may be combined in a variety of ways with each other. Therefore, it is to be understood that, within the scope of the appended claims, the claimed invention may be practiced other than as explicitly described herein.

All references and publications cited herein are expressly incorporated herein by reference in their entirety into this disclosure, except to the extent they may directly contradict this disclosure.

Unless otherwise indicated, all numbers expressing feature sizes, amounts, and physical properties used in the specification and claims may be understood as being modified either by the term "exactly" or "about." Accordingly, unless indicated to the contrary, the numerical parameters set forth in the foregoing specification and attached claims are approximations that can vary depending upon the desired properties sought to be obtained by those skilled in the art utilizing the teachings disclosed herein or, for example, within typical ranges of experimental error.

The recitation of numerical ranges by endpoints includes all numbers subsumed within that range (e.g. 1 to 5 includes 1, 1.5, 2, 2.75, 3, 3.80, 4, and 5) and any range within that range. Herein, the terms "up to" or "no greater than" a number (e.g., up to 50) includes the number (e.g., 50), and the term "no less than" a number (e.g., no less than 5) includes the number (e.g., 5).

The terms "coupled" or "connected" refer to elements being attached to each other either directly (in direct contact with each other) or indirectly (having one or more elements between and attaching the two elements). Either term may be modified by "operatively" and "operably," which may be used interchangeably, to describe that the coupling or connection is configured to allow the components to interact to carry out at least some functionality (for example, a radio chip may be operably coupled to an antenna element to provide a radio frequency electric signal for wireless communication).

Terms related to orientation, such as "top," "bottom," "side," and "end," are used to describe relative positions of components and are not meant to limit the orientation of the embodiments contemplated. For example, an embodiment described as having a "top" and "bottom" also encompasses embodiments thereof rotated in various directions unless the content clearly dictates otherwise.

Reference to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout are not necessarily referring to the same embodiment of the disclosure. Furthermore, the particular features, configurations, compositions, or characteristics may be combined in any suitable manner in one or more embodiments.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

As used herein, "have," "having," "include," "including," "comprise," "comprising" or the like are used in their open-ended sense, and generally mean "including, but not limited to." It will be understood that "consisting essentially of" "consisting of," and the like are subsumed in "comprising," and the like.

The term "and/or" means one or all of the listed elements or a combination of at least two of the listed elements.

The phrases "at least one of," "comprises at least one of," and "one or more of" followed by a list refers to any one of the items in the list and any combination of two or more items in the list.

What is claimed is:

1. An ear-worn electronic device configured to be worn by a wearer, comprising:

an enclosure configured to be supported by or in an ear of the wearer;

electronic circuitry disposed in the enclosure and comprising a wireless transceiver;

an antenna in or on the enclosure and operably coupled to the wireless transceiver, the antenna comprising:

a first antenna element;

a second antenna element; and a chip antenna operably coupled to the first and second antenna elements; and a matching network disposed between the wireless transceiver and feed conductors of the antenna, wherein the matching network is configured to substantially cancel a reactance of the antenna at the feed conductors that is modified by a reactance of the chip antenna.

2. The device of claim 1, wherein the chip antenna is tuned to a frequency in a range from 2.4 up to 2.5 GHz.

3. The device of claim 1, wherein the chip antenna comprises a plurality of alternating layers in which meandering conductor layers alternate with dielectric layers.

4. The device of claim 1, wherein the chip antenna has an impedance having a real component configured to radiate an electric field and a reactive component configured to tune the antenna.

5. The device of claim 1, further comprising a reactive component coupled between the first and second antenna elements.

6. The device of claim 5, wherein the reactive component comprises at least one of a capacitor and an inductor.

7. The device of claim 5, wherein the reactive component comprises at least one of an interdigitated capacitor, an L-C network, or an RLC network.

8. The device of claim 5, wherein the reactive component comprises at least one of a distributed component or a shaped region that functions as the reactive component.

9. The device of claim 1, wherein the antenna comprises a strap between the first and second antenna elements, wherein the chip antenna comprises a surface mounted component disposed on the strap.

10. The device of claim 1, wherein the chip antenna is disposed on the first antenna element and the antenna further comprises at least one additional chip antenna disposed on the second antenna element to balance loading of the antenna elements.

11. The device of claim 1, wherein:

the antenna comprises the first antenna element, the second antenna element, and one or more additional antenna elements;

the chip antenna is a first chip antenna; and one or more chip antennas are coupled between the first, second, and the one or more additional antenna elements, the one or more chip antennas include the first chip antenna.

12. The device of claim 1, wherein the antenna is configured as a bowtie antenna.

13. An ear-worn electronic device configured to be worn by a wearer, comprising:

an enclosure configured to be supported by or in an ear of the wearer;

electronic circuitry disposed in the enclosure and comprising a wireless transceiver; and an antenna in or on the enclosure and comprising:

a first antenna element having a first side and an opposing second side, the first side connected to a first feed line conductor;

a second antenna element having a first side and an opposing second side, the first side of the second antenna element connected to a second feed line conductor, the first and second feed line conductors coupled to the wireless transceiver;

a strap connected to the second side of the first antenna element and the second side of the second antenna element; and the strap comprising a chip antenna, wherein the chip antenna comprises a plurality of meandering conductor layers that alternate with one or more dielectric layers.

14. The device of claim 13, wherein the chip antenna is tuned to a frequency in a range from 2.4 up to 2.5 GHz.

15. The device of claim 13, wherein the chip antenna has an impedance having a real component configured to radiate an electric field and a reactive component configured to tune the antenna.

16. The device of claim 13, wherein the chip antenna is a first chip antenna and the device further comprises one or more reactive components and one or more chip antennas including the first chip antenna, each of the one or more reactive components and the one or more chip antennas coupled between the first and second antenna elements.

17. The device of claim 16, wherein each of the one or more reactive components comprises at least one of a capacitor and an inductor.

18. The device of claim 17, wherein each of the one or more reactive components comprises at least one of an interdigitated capacitor, an L-C network, or an RLC network.

19. The device of claim 16, wherein each of the one or more reactive components comprises at least one of a distributed component and a shaped region that functions as the reactive component.

20. The device of claim 13, wherein the chip antenna comprises a surface mounted component disposed on the strap.

21. The device of claim 13, wherein the chip antenna is disposed on the first antenna element and the antenna further comprises at least one additional chip antenna disposed on the second antenna element to balance loading of the antenna elements.

22. The device of claim 13, further comprising a matching network disposed between the wireless transceiver and feed conductors of the antenna, wherein the matching network is configured to substantially cancel a reactance of the antenna at the feed conductors that is modified by a reactance of the chip antenna.

23. An electronic device comprising:

a wireless transceiver;

an antenna operably coupled to the wireless transceiver, the antenna comprising:

a first antenna element;

a second antenna element; and a chip antenna without a ground plane operably coupled to the first and second antenna elements and configured to radiate with the first and second antenna elements and reactively load the antenna; and a matching network disposed between the wireless transceiver and feed conductors of the antenna, wherein the matching network is configured to substantially cancel a reactance of the antenna at the feed conductors that is modified by a reactance of the chip antenna.

24. An ear-worn electronic device configured to be worn by a wearer, comprising:

an enclosure configured to be supported by or in an ear of the wearer;

electronic circuitry disposed in the enclosure and comprising a wireless transceiver; and an antenna in or on the enclosure and operably coupled to the wireless transceiver, the antenna comprising:

a first antenna element;

a second antenna element; and a chip antenna operably coupled to the first and second antenna elements, wherein the chip antenna comprises a plurality of alternating layers in which meandering conductor layers alternate with dielectric layers.

25. An ear-worn electronic device configured to be worn by a wearer, comprising:

an enclosure configured to be supported by or in an ear of the wearer;

electronic circuitry disposed in the enclosure and comprising a wireless transceiver; and an antenna in or on the enclosure and operably coupled to the wireless transceiver, the antenna comprising:

a first antenna element;

a second antenna element;

a strap between the first and second antenna elements; and a chip antenna operably coupled to the first and second antenna elements, wherein the chip antenna comprises a surface mounted component disposed on the strap, wherein the chip antenna comprises a plurality of meandering conductor layers that alternate with one or more dielectric layers.

26. An ear-worn electronic device configured to be worn by a wearer, comprising:

an enclosure configured to be supported by or in an ear of the wearer;

electronic circuitry disposed in the enclosure and comprising a wireless transceiver; and an antenna in or on the enclosure and operably coupled to the wireless transceiver, the antenna comprising:

a first antenna element;

a second antenna element;

a first chip antenna disposed on the first antenna element, wherein the first chip antenna comprises a first plurality of meandering conductor layers that alternate with one or more first dielectric layers; and a second chip antenna disposed on the second antenna element to balance loading of the first antenna element and the second antenna element, wherein the second chip antenna comprises a second plurality of meandering conductor layers that alternate with one or more second dielectric layers.

* * * * *